United States Patent [19]

Inomata et al.

[11] Patent Number: 4,462,826

[45] Date of Patent: Jul. 31, 1984

[54] LOW-LOSS AMORPHOUS ALLOY

[75] Inventors: Koichiro Inomata, Yokohama; Michio Hasegawa, Tokyo; Tadahiko Kobayashi, Yokohama, all of Japan

[73] Assignee: Tokyo Shibaura Denki Kabushiki Kaisha, Kawasaki, Japan

[21] Appl. No.: 415,489

[22] Filed: Sep. 7, 1982

[30] Foreign Application Priority Data

| | | | |
|---|---|---|---|
| Sep. 11, 1981 | [JP] | Japan | 56-142250 |
| Sep. 11, 1981 | [JP] | Japan | 56-142251 |
| Feb. 26, 1982 | [JP] | Japan | 57-28936 |

[51] Int. Cl.[3] ..... F16H 29/10

[52] U.S. Cl. ..... 75/123 B; 148/31.55; 75/123 J; 75/123 L; 75/126 F; 75/126 P; 75/126 Q

[58] Field of Search ..... 75/123 J, 123 B, 123 L, 75/126 C, 126 E, 126 F, 126 P, 126 Q; 148/31.55

[56] References Cited

U.S. PATENT DOCUMENTS

| | | | |
|---|---|---|---|
| 3,986,867 | 10/1976 | Masumoto et al. | 75/126 K |
| 4,067,732 | 1/1978 | Ray | 75/123 K |
| 4,116,682 | 9/1978 | Polk et al. | 75/123 L |
| 4,152,144 | 5/1979 | Hasegawa et al. | 75/122 |
| 4,225,339 | 9/1980 | Inomata et al. | 75/122 |

FOREIGN PATENT DOCUMENTS

| | | | |
|---|---|---|---|
| 2257700 | 8/1975 | France . | |
| 2317370 | 2/1977 | France . | |
| 2376218 | 7/1978 | France . | |
| 54-72715 | 6/1979 | Japan | 75/123 J |

*Primary Examiner*—John P. Sheehan

*Attorney, Agent, or Firm*—Schwartz, Jeffery, Schwaab, Mack, Blumenthal & Koch

[57] ABSTRACT

There is disclosed a low-loss amorphous alloy represented by the following formula:

$$(Fe_{1-a-b}Nb_aM_b)_{100-c}X_c$$

wherein M is at least one metallic element selected from the group consisting of V, Cr, Mo, Ta and W; X is B or a combination of B and Si (the amount of the Si is 10 or less atomic percent of its formula weight); and a, b and c satisfy the relation of $0.01 \leqq a \leqq 0.075$, $0 \leqq b \leqq 0.05$, $0.02 \leqq a+b \leqq 0.075$ and $12 \leqq c \leqq 21$, respectively.

The amorphous alloys of the present invention exhibit larger saturation magnetic flux densities and less iron losses than the conventional ferrite at a high frequency region.

9 Claims, 4 Drawing Figures

LOW-LOSS AMORPHOUS ALLOY

The present invention relates to a low-loss amorphous alloy effectively usable for a magnetic core in an electromagnetic apparatus, more particularly, to a low-loss amorphous alloy which has magnetic characteristics of reducing an iron loss and improving a thermal stability in a high-frequency region and which is suitable for a material of the magnetic core used at a high frequency as in a switching regulator.

Heretofore, by way of a magnetic core usable under a high frequency as in a switching regulator, there have been used crystalline materials such as a permalloy and a ferrite.

However, having a small specific resistance, a permalloy is large in iron loss in a high-frequency region. Further, in the case of a ferrite, its saturation magnetic flux density is as small as at most 5000 G, though the loss at a high frequency is small. For this reason, when the ferrite is used in a large working magnetic flux density, it will be almost saturated therewith and as a result the iron loss will increase. In recent years, as for a transformer used at a high frequency such as power source transformer which a switching regulator carrier, its miniaturization is desired. In this case, however, it is necessary to increase a working magnetic flux density, but this augmentation leads to an enlarged iron loss of the ferrite. Therefore, the inconsistency just described is a great problem for the realization of the ferrite.

On the other hand, much attention is nowadays paid to amorphous magnetic alloys not having crystalline structure, because they exhibit excellent soft magnetic characteristics such as high permeability and low coersive force. These amorphous magnetic alloys comprise Fe, Co and Ni which are basic elements, as well as P, C, B, Si, Al and Ge which are elements (metalloids) for rendering the alloys amorphous.

However, all of these amorphous magnetic alloys are not small in iron loss in the region of a high frequency. For instance, a Fe series amorphous alloy shows as very small an iron loss as about $\frac{1}{4}$ of that of a silicon steel in a low frequency region of 50 to 60 Hz, but is noticeably great in iron loss in a high frequency region of 10 to 50 KHz, which fact does not allow at all it to be employed in a high frequency region as in a switching regulator or the like. Further, in the case of conventional Fe series amorphous alloys, in order to obtain a low loss, it is necessary to subject the alloys to a heat treatment in a magnetic field. This brings the manufacture of them into completion. Additionally, the thus treated alloys have a low crystallization temperature, and hence are disadvantageously lacking in thermal stability.

Heretofore, it has been known that when a portion of the Fe in a Fe series amorphous alloy is replaced with an element such as Nb, Cr, Mo, W or V, the resultant amorphous alloy will be possessed of a high permeability. "The Data of Society for the Research of Magnetic Record," VR31-5; Japanese Provisional Patent Publication No. 73920/1976 and U.s. Pat. No. 4,225,339.

Further, it has also been known that if Nb is added in manufacturing an amorphous alloy, the resultant amorphous alloy will be reduced in Curie temperature and saturation magnetization. However, the influence of Nb on magnetic characteristics such as iron loss and thermal stability has not been elucidated yet.

The inventors of the present application have found that components of a Fe series amorphous alloy which brings a high permeability do not always lead to a low iron loss.

On the basis of this finding, the present inventors have researched with enthusiasm for the purpose of overcoming the above-mentioned disadvantages inherent in amorphous alloys, and at last have found out that amorphous alloys prepared by replacing a portion of the Fe therein with a predetermined atomic percent of Nb and further replacing a portion of the Fe therein with a predetermined atomic percent of one or more elements of Cr, Mo, Ta, W and V are small in iron loss even in the region of a high frequency and can be manufactured through a heat treatment in a non-magnetic field, and finally the amorphous alloy of the present invention has been now accomplished.

An object of the present invention is to provide an amorphous alloy having magnetic characteristics capable of reducing an iron loss in a high frequency region.

That is to say, a low-loss amorphous alloy of the present invention is characterized by being represented by the following formula (I):

$$(Fe_{1-a-b}Nb_aM_b)_{100-c}X_c \quad (I)$$

wherein M is at least one metallic element selected from the group consisting of V, Cr, Mo, Ta and W; X is B or a combination of B and Si (the amount of the Si is 10 or less atomic percent of its formula weight); and a, b and c satisfy the relations of $0.01 \leqq a \leqq 0.075$, $0 \leqq b \leqq 0.05$, $0.02 \leqq a+b \leqq 0.075$ and $12 \leqq c \leqq 21$, respectively.

Figure 1:
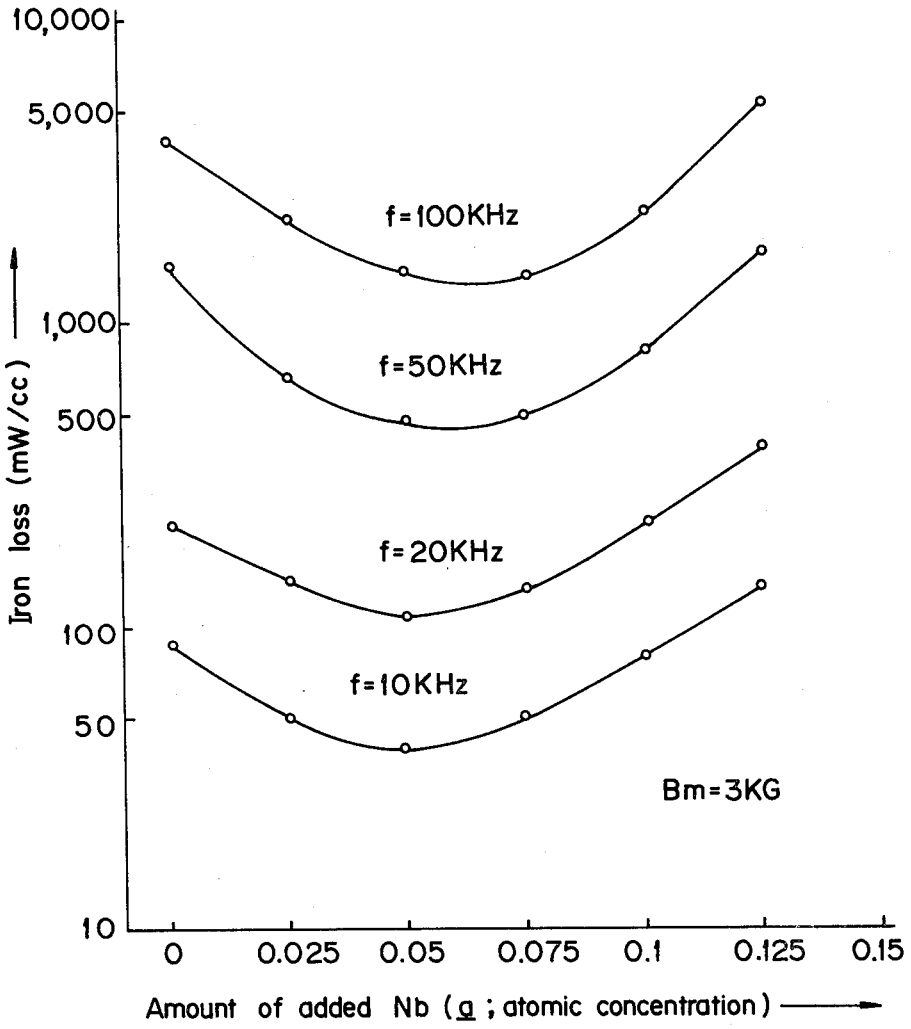
FIGS. 1 and 2 show relation diagrams between amounts of the added Nb in the amorphous alloys of the present invention and iron losses at the respective frequencies at a magnetic flux density Bm=3 KG, respectively.

In the following, the present invention will be explained more in detail.

In this specification, the indication a, b and c have meanings as mentioned below;

a: rate of Nb when the total number of Fe, Nb and M is assumed to be 1, b: rate of M (metallic element) atom when the total number of Fe, Nb and M is assumed to be 1, and c: percentage of X based on the total number of atoms, Fe, Nb, M and X.

The low-loss amorphous alloys denoted by the above-mentioned formula can be classified into the following two types.

A first type of the amorphous alloy does not include any V, Cr, Mo, Ta or W, and is represented by a formula (II):

$$(Fe_{1-a}Nb_a)_{100-c}X_c \quad (II)$$

wherein X and c have the same meanings as in formula (I), and a satisfies the relation of $0.01 \leqq a \leqq 0.075$.

In the amorphous alloy denoted by the formula (II), it is preferred to allow the amount of each component of the amorphous alloy to fall within the range specified below;

$$0.02 \leqq a \leqq 0.075 \text{ and } 17 \leqq c \leqq 19.$$

A second type of the amorphous alloy is represented by a formula (III):

$$(Fe_{1-a-b}Nb_aM_b)_{100-c}X_c \quad \text{(III)}$$

wherein M, X and c have the same meanings as in formula (I), and a and b satisfy the relations of $0.01 \leqq a \leqq 0.075$, $0 < b \leqq 0.05$ and $0.02 \leqq a+b \leqq 0.075$, respectively.

In the amorphous alloy denoted by the formula (III), it is preferred to allow the amount of each component of the amorphous alloy to fall within the range specified below;

$0.01 \leqq a \leqq 0.065$, $0.01 \leqq b \leqq 0.05$, $0.03 \leqq a+b \leqq 0.07$ and $17 \leqq c \leqq 19$, respectively.

In regard to the amorphous alloys denoted by the above-mentioned formula (I), reasons for adding the respective elements, rates of components and reasons for defining these rates are as follows:

The amorphous alloys represented by the formula (I) of the present invention are made up of iron (Fe) as a principal ingredient and a variety of elements.

In the amorphous alloy denoted by the formula (I), the component niobium (Nb) is conductive to the reduction in iron loss in a high frequency region and the elevation of a crystallization temperature, and the rate a of the Nb is set within the range of $0.01 \leqq a \leqq 0.075$ in atomic concentration. When the rate a is less than 0.01, the aforesaid effects cannot be obtained to a substantial extent. On the other hand, when the rate a is excess of 0.075, the Curie temperature of the amorphous alloy will lower and thereby its practicability will be lost.

The metallic element M contributes to the reduction in iron loss in a high frequency region together with Nb. The element M is at least one metallic element selected from the group consisting of vanadium (V), chromium (Cr), molybdenum (Mo), tantalum (Ta) and tungsten (W). In the amorphous alloy represented by the formula (I), the rate b of M is set within the range of $0 \leqq b \leqq 0.05$ in atomic concentration. When the rate b exceeds 0.05, the iron loss will increase.

In the amorphous alloy represented by the formula (I), the total rates a+b of Nb and M to Fe is set within the range of $0.02 \leqq a+b \leqq 0.075$ in atomic concentration. In the case that the rate a+b is less than 0.02, the above-mentioned effects of the amorphous alloy will not be satisfactorily obtained. On the other hand, if the rate a+b exceeds 0.075, the iron loss will increase.

In the amorphous alloy denoted by the formula (I), the symbol X represents an element essential to render the alloy amorphous and is boron (B) or a combinatin of boron (B) and silicon (Si). When the combination of B and Si is used, the amount of the Si should be 10 or less atomic percent. If the amount of the Si is in excess of 10 atomic percent, the resultant alloy will increase in the iron loss. In the amorphous alloy of the present invention, the compounding amount c of X is set within the range satisfying the relation of $12 \leqq c \leqq 21$ in the percentage of the total number of atoms. In the case that the rate c is less than 12, it will be difficult to make the alloy amorphous, on the other hand, when it exceeds 21, the effects of the added Nb and M on the iron loss will not be so noticeable. In the case that the rate c in the formula (I) fulfills the relation of $17 \leqq c \leqq 19$, the iron loss in a high frequency region will advantageously decrease more effectively.

The amorphous alloy of the present invention can easily be prepared by mixing the components of the above-mentioned Fe, Nb, M (which has the above-defined meaning) and X (B or a combination of B and Si) at predetermined rates, followed by melting, making the alloy amorphous by, for example, a melt quenching method (IEEE Trans. Mag. *MAG*-13 (1977) 1541) and subjecting the alloy to a thermal treatment at a temperature within the range of 380° to 520° C. in a non-magnetic field.

Further, in the amorphous alloy of the present invention denoted by the formula (I), wherein the rate b equals 0 and c satisfies the relation of $17 \leqq c \leqq 19$, the amorphous alloy having extremely low in the iron loss in a high frequency region is obtainable by treating the amorphous alloy under heating at a temperature which is lower than its crystallization temperature by 40° to 70° C. and not less than its Curie temperature in a non-magnetic field for 10 minutes to 3 hours.

In the following, the present invention will be explained on the basis of the examples.

EXAMPLE 1

Ten kinds of the amorphous alloys (Sample Nos. 1 to 10) of the compositions shown in Table 1 were prepared by means of a roll quenching method. That is to say, each molten alloy of the above compositions was gushed by the pressure of argon gas (1.0 to 2.0 kg/cm$^2$) from the nozzle of a quartz pipe to the space between two rolls rotating at a high speed, and the resultant thin body was quenched to prepare a thin strip of 2 mm wide, 30 μm thick and 10 m long. The strip was cut in samples of 100 cm long, each of the thus prepared samples was wound on an aluminum bobbin of 20 mm in diameter, and then, with respect to the Sample Nos. 1 to 5 the whole of each bobbine with sample was subjected to the heat treatment at 430° C. for a period of 10 minutes in a non-magnetic field, and with respect to the Sample Nos. 6 to 10 the whole of each bobbin with sample was subjected to the heat treatment at 460° C. for a period of 30 minutes in a non-magnetic field, respectively. Each sample thus treated was associated with a primary and a secondary coil (in both the coils, number of turns was 70), and was measured for iron losses (mW/cc) at a magnetic flux density Bm=3 KG (kilogaus) at frequencies of 10 KHz, 20 KHz, 50 KHz and 100 KHz by use of a wattmeter.

Further, saturation magnetizations were also measured by use of a sample vibrating type magnetometer, magnetic strain constants were measured by means of a strain gauge method, and crystallization temperatures were evaluated in accordance with a DTA (differential thermal analysis). Obtained results are shown together corresponding to each composition constituting an amorphous alloy in Table 1 below.

COMPARATIVE EXAMPLE 1

Three kinds of the amorphous alloys (Sample Nos. 11 to 13) were prepared as the same procedures in Example 1 except that the composition of the amorphous alloys were varied. Further, a Mn-Zn ferrite (Sample No. 14) which has been used for a switching power source is used as a comparative material.

As to above-mentioned 4 kinds of samples, iron losses, saturation magnetizations, crystallization temperatures and magnetic strain constants were also measured as the same procedures in Example 1.

These compositions and measurement results are also shown in Table 1 therewith.

TABLE 1

| | Sample No. | Composition | Iron loss (mW/cc) at magnetic flux density Bm = 3 KG 10 KHz | 20 KHz | 50 KHz | 100 KHz | Saturation magnetization (G) | Crystallization temperature (°C.) | Magnetic strain Constant ($\times 10^{-6}$) |
|---|---|---|---|---|---|---|---|---|---|
| Example 1 | 1 | $(Fe_{0.98}Nb_{0.02})_{83}Si_5B_{12}$ | 60 | 150 | 750 | 2500 | 15000 | 510 | 18 |
| | 2 | $(Fe_{0.95}Nb_{0.05})_{83}Si_5B_{12}$ | 40 | 110 | 480 | 1500 | 12300 | 530 | 10 |
| | 3 | $(Fe_{0.925}Nb_{0.075})_{83}Si_5B_{12}$ | 50 | 135 | 500 | 1400 | 11000 | 545 | 8 |
| | 4 | $(Fe_{0.95}Nb_{0.05})_{79}Si_7B_{14}$ | 50 | 130 | 550 | 1900 | 12000 | 540 | 20 |
| | 5 | $(Fe_{0.925}Nb_{0.075})_{79}Si_7B_{14}$ | 60 | 155 | 800 | 2400 | 10500 | 550 | 15 |
| | 6 | $(Fe_{0.95}Nb_{0.05})_{86}Si_2B_{12}$ | 10 | 95 | 330 | 1200 | 10500 | 460 | 5 |
| | 7 | $(Fe_{0.95}Nb_{0.05})_{87}Si_1B_{12}$ | 8 | 90 | 310 | 1000 | 9900 | 440 | 4 |
| | 8 | $(Fe_{0.95}Nb_{0.05})_{88}B_{12}$ | 6 | 85 | 290 | 950 | 9400 | 420 | 2 |
| | 9 | $(Fe_{0.97}Nb_{0.03})_{88}B_{12}$ | 15 | 99 | 360 | 1100 | 13500 | 400 | 4 |
| | 10 | $(Fe_{0.95}Nb_{0.05})_{87}Si_3B_{10}$ | 9 | 95 | 320 | 1350 | 9600 | 450 | 5 |
| Comparative Example 1 | 11 | $Fe_{83}Si_5B_{12}$ | 110 | 210 | 1500 | 4000 | 17000 | 450 | 35 |
| | 12 | $(Fe_{0.95}Nb_{0.05})_{75}Si_{10}B_{15}$ | 130 | 250 | 1800 | 5000 | 13000 | 510 | 20 |
| | 13 | $(Fe_{0.90}Nb_{0.10})_{75}Si_{10}B_{15}$ | 150 | 350 | 2100 | 6500 | 11000 | 525 | 15 |
| | 14 | Mn—Zn ferrite | 90 | 200 | 850 | — | 4000 | — | — |

As is definite from the shown results, the amorphous alloys of the present invention have larger saturation magnetic flux densities than the conventional ferrite and less iron losses than the ferrite. Further, in regard to the alloys of the present invention, the magnetic strains are so small compared with the amorphous alloy of Comparative Examples. Accordingly, the amorphous alloys of the present invention exhibit less deterioration of magnetic characteristics corresponding to the stress.

EXAMPLE 2

Amorphous alloys of $(Fe_{1-a}Nb_a)_{81}Si_6B_{13}$ were prepared varying the amounts a of the added Nb thereof in the same manner as in Example 1. These alloys were measured for iron losses under a magnetic flux density Bm=3 KG at frequencies of 10 KHz, 20 KHz, 50 KHz and 100 KHz. Results obtained are shown in FIG. 1 in the form of diagrams about relations between the iron losses and the amounts of the added Nb.

Further, amorphous alloys of $(Fe_{1-a}Nb_a)_{86}Si_2B_{12}$ were prepared varying the amounts a of the added Nb thereof in the same manner as in Example 1. These alloys were also measured for iron losses under a magnetic flux density Bm=3 KG at frequencies of 10 KHz, 20 KHz, 50 KHz and 100 KHz. Results obtained are shown in FIG. 2 in the form of diagrams about relations between the iron losses and the amounts of the added Nb.

Figure 2:
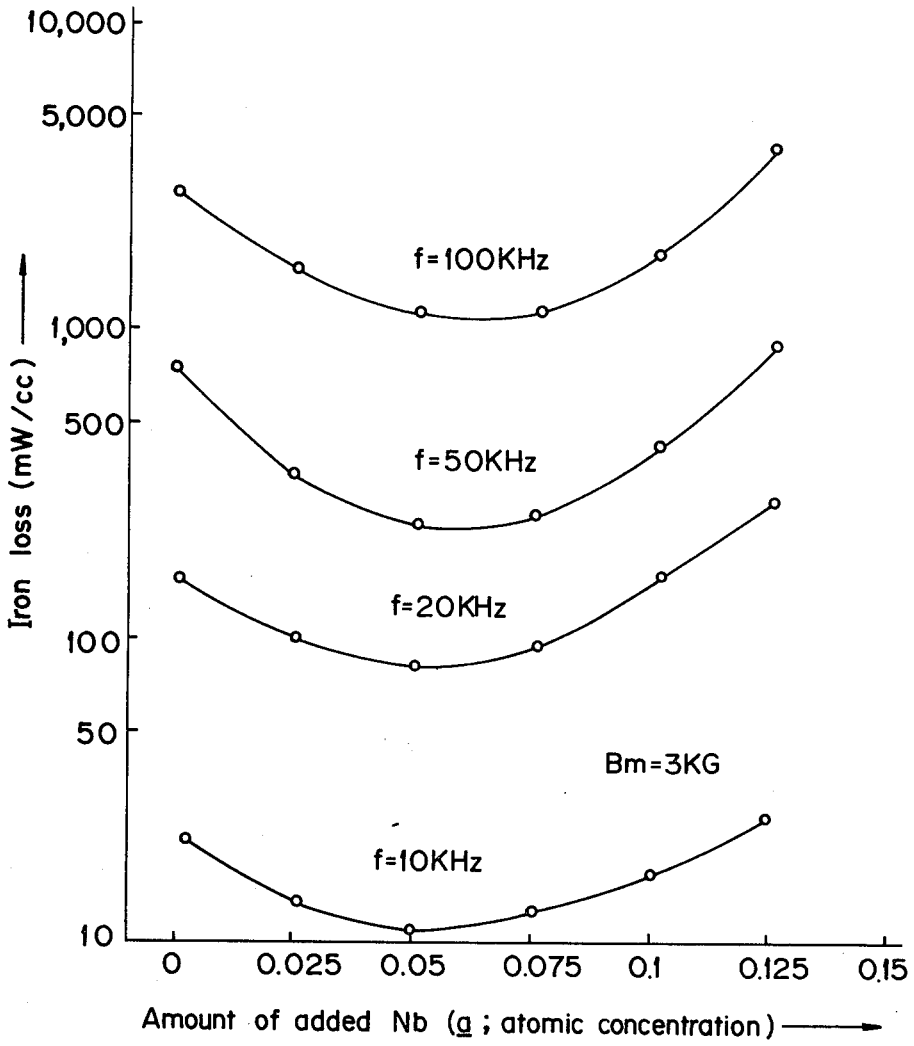

As is definite from the results in FIG. 1 and FIG. 2, the amorphous alloy according to the present invention are especially small in the iron loss, when the rate a is in the range of $0.02 \leqq a \leqq 0.075$.

EXAMPLE 3

Twelve kinds of the amorphous alloys (Sample Nos. 15 to 26) of the compositions shown in Table 2 were prepared by means of a roll quenching method in the same manner as in Example 1. That is to say, each molten alloy of the above composition was gushed by the pressure of argon gas (1.0 to 2.0 kg/cm$^2$) from the nozzle of a quartz pipe to the space between two rolls rotating at a high speed, and the resultant thin body was quenched to prepare a thin strip of 20 mm wide, 30 μm thick and 10 m long. The strip was cut in the samples of 140 cm long, each of the thus prepared samples was wound on an aluminum bobbin of 20 mm in diameter, and the whole of each bobbin with samples was subjected to the heat treatment at 400° C. for a period of 15 minutes in a non-magnetic field. Each thus treated sample was associated with a primary and a secondary coil (in both coils, number of turns was 70), and was measured for iron losses. Further, each amorphous alloys was measured for saturation magnetization and magnetic strain constant, respectively.

The iron losses were measured at a working magnetic flux density Bm=3 KG at frequencies of 10 KHz, 20 KHz, 50 KHz and 100 KHz by use of a wattmeter. Further, saturation magnetizations were measured by use of a sample vibrating type magnetometer, and magnetic strain constants were measured by means of a strain gauge method, respectively. Obtained results are shown together corresponding to each composition constituting an amorphous alloy in Table 2 below.

COMPARATIVE EXAMPLE 2

Three kinds of the amorphous alloys (Sample Nos. 27 to 29) were prepared as the same procedures in Example 3 except that the composition of the amorphous alloys were varied. These samples were measured for iron losses, saturation magnetizations and magnetic strain constants as the same in Example 3, respectively. Obtained results are shown together corresponding to each composition constituting an amorphous alloy in Table 2 both with Example 3. Further, measurement results regarding a Mn-Zn ferrite which has heretofore been used for a switching power source are also shown there.

TABLE 2

| | Sample No. | Composition | Iron loss (mW/cc) at magnetic flux density Bm = 3 KG 10 KHz | 20 KHz | 50 KHz | 100 KHz | Saturation magnetization (G) | Magnetic strain Constant ($\times 10^{-6}$) |
|---|---|---|---|---|---|---|---|---|
| Example 3 | 15 | $(Fe_{0.95}Nb_{0.025}Cr_{0.025})_{83}Si_5B_{12}$ | 65 | 140 | — | — | 12400 | — |
| | 16 | $(Fe_{0.925}Nb_{0.025}Cr_{0.05})_{83}Si_5B_{12}$ | 38 | 105 | — | — | 11300 | — |
| | 17 | $(Fe_{0.95}Nb_{0.02}Mo_{0.03})_{82}Si_6B_{12}$ | 50 | 110 | — | — | 12500 | — |
| | 18 | $(Fe_{0.95}Nb_{0.02}Ta_{0.03})_{82}Si_6B_{12}$ | 56 | 110 | — | — | 12600 | — |
| | 19 | $(Fe_{0.95}Nb_{0.02}W_{0.03})_{82}Si_6B_{12}$ | 58 | 110 | — | — | 12700 | — |
| | 20 | $(Fe_{0.95}Nb_{0.02}V_{0.03})_{82}Si_6B_{12}$ | 59 | 115 | — | — | 12500 | — |
| | 21 | $(Fe_{0.95}Nb_{0.025}Cr_{0.025})_{86}Si_2B_{12}$ | 15 | 110 | 380 | 1400 | 10700 | 6 |
| | 22 | $(Fe_{0.95}Nb_{0.025}Cr_{0.025})_{87}Si_1B_{12}$ | 13 | 100 | 360 | 1300 | 10300 | 5 |
| | 23 | $(Fe_{0.95}Nb_{0.02}Mo_{0.03})_{87}Si_1B_{12}$ | 13 | 100 | 370 | 1350 | 10100 | 5 |
| | 24 | $(Fe_{0.95}Nb_{0.02}Ta_{0.03})_{87}Si_1B_{12}$ | 14 | 110 | 380 | 1400 | 10200 | 5.5 |
| | 25 | $(Fe_{0.95}Nb_{0.02}W_{0.03})_{87}Si_1B_{12}$ | 14 | 110 | 380 | 1400 | 10300 | 5.5 |
| | 26 | $(Fe_{0.95}Nb_{0.02}V_{0.03})_{87}Si_1B_{12}$ | 15 | 115 | 390 | 1500 | 10500 | 6 |
| Comparative Example 2 | 27 | $Fe_{83}Si_5B_{12}$ | 110 | 210 | 1500 | 4000 | 17000 | 35 |
| | 28 | $(Fe_{0.95}Cr_{0.05})_{75}Si_{10}B_{15}$ | 150 | 350 | 1950 | 5500 | 13000 | 20 |
| | 29 | $(Fe_{0.90}Cr_{0.10})_{75}Si_{10}B_{15}$ | 130 | 250 | — | — | 11000 | — |
| | 30 | Mn—Zn ferrite | 90 | 200 | 850 | — | 4000 | — |

As seen from the Table 2, the results indicate that the amorphous alloys of the present invention have larger saturation magnetic flux densities than the conventional ferrite and comparative amorphous alloys, and less iron losses than the same.

EXAMPLE 4

Amorphous alloys ($a=0.02$) of $(Fe_{0.98-b}Nb_{0.02}Cr_b)_{82}Si_6B_{12}$ were prepared varying the amount of Cr selected as M in the same manner as in Example 1. These alloys were measured for iron losses under a magnetic flux density Bm=3 KG at frequencies of 10 KHz and 20 KHz. Results obtained are shown in the form of diagrams about relations between the iron losses and the amounts (b) of the added Cr in FIG. 3.

Further, amorphous alloys (a=0.02) of $(Fe_{0.98-b}Nb_{0.02}Cr_b)_{86}Si_2B_{12}$ were prepared varying the amounts b from 0 to 0.06 of the added Cr selected as M in the same manner as in Example 1. These alloys were also measured as above alloys for iron losses under a magnetic flux density Bm=3 KG at respective frequencies of 10 KHz and 20 KHz. Results obtained are also shown in the form of diagrams about relations between the iron losses and the amounts (b) of the added Cr in FIG. 4.

Figure 3:
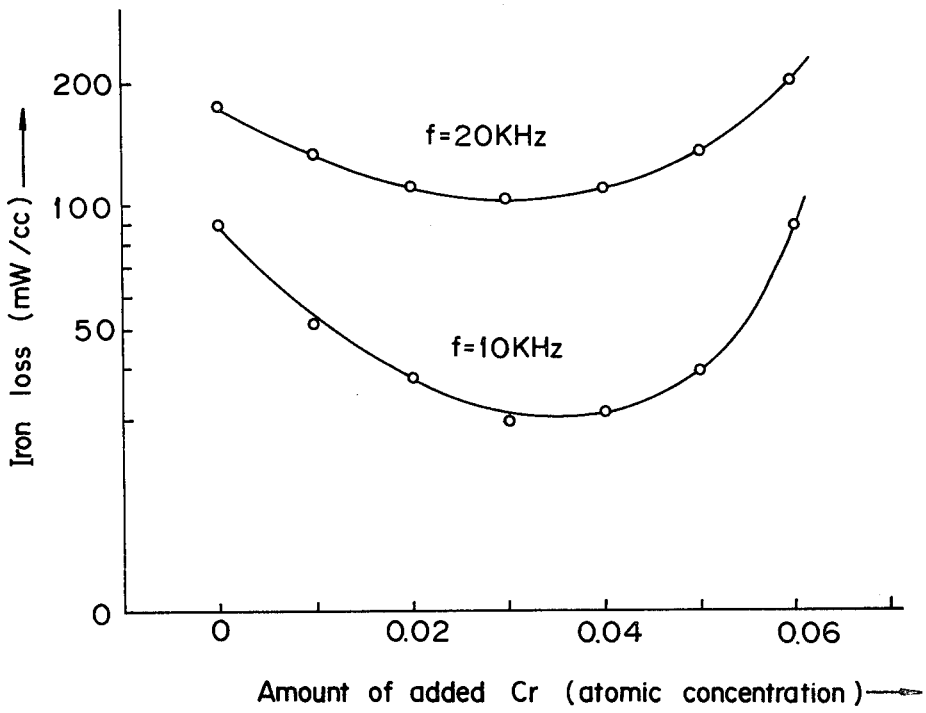
FIGS. 3 and 4 show relation diagrams between amounts of the added Cr in the amorphous alloys of the present invention and iron losses at frequencies of 10 KHz and 20 KHz at a magnetic flux density Bm=3 KG, respectively.
Figure 4:
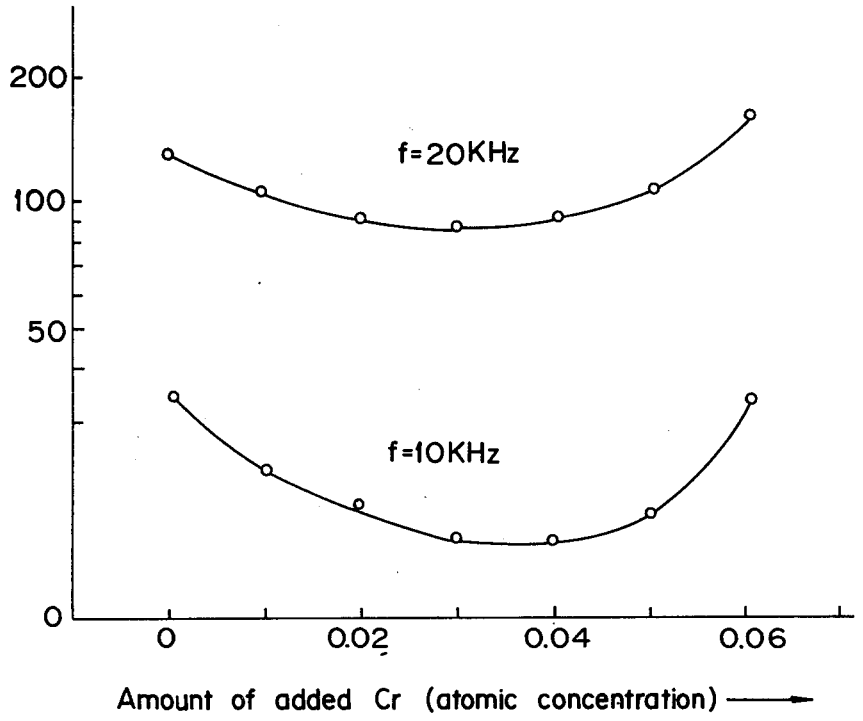

As is definite from the FIGS. 3 and 4, the iron losses of the amorphous alloys according to the present invention are especially small when the ratio b is in the range of $0.01 \leqq b \leqq 0.05$, thus $0.03 \leqq a+b \leqq 0.07$.

In the like manner, when each of Mo, Ta, W and V was selected as M, the same results as in the case of Cr were obtained in accordance with the same measurements.

As understood from the foregoing, in the amorphous alloys of the present invention, the saturation magnetic flux densities are larger than in the conventional ferrite, the iron losses at high frequencies are less than in the ferrite, the cost is inexpensive because of the employment of iron as the principal component, and the miniaturization is possible, which permits them to be adapted to high-frequency transformers. Therefore, these alloys of the present invention are beneficial on an industrial scale.

We claim:

1. A low-loss amorphous alloy for a toroidal core material consisting essentially of the following formula:

$$(Fe_{1-a-b}Nb_aM_b)_{100-c}X_c$$

wherein M is at least one metallic element selected from the group consisting of V, Cr, Mo, Ta and W; X is a combination of B and Si, the amount of Si being more than 0 to 10 or less atomic percent; and a, b and c satisfy the relations of $0.01 \leqq a \leqq 0.075$, $0 \leqq b \leqq 0.05$, $0.02 \leqq a+b \leqq 0.075$ and $12 \leqq c \leqq 21$, respectively.

2. A low-loss amorphous alloy according to claim 1, wherein c in said formula satisfies the relation of $17 \leqq c \leqq 19$.

3. A low-loss amorphous alloy according to claim 1 wherein said alloy has been heat treated at a temperature not more than its crystallization temperature in a non-magnetic field.

4. A low loss amorphous alloy as defined in claim 1 and wherein a satisfies the relation of $0.02 \leqq a \leqq 0.075$ and $b=0$.

5. A low loss amorphous alloy as defined in claim 1 and wherein a and b satisfy the relations of $0.01 \leqq a \leqq 0.065$, $0.01 \leqq b \leqq 0.05$, and $0.02 \leqq a+b \leqq 0.075$.

6. A low-loss amorphous alloy according to claim 4, wherein c in said formula satisfies the relation of $17 \leqq c \leqq 19$.

7. A low-loss amorphous alloy according to claim 6, wherein said alloy has been heat treated at a temperature which is lower than its crystallization temperature by 40° to 70° C. and not less than its Curie temperature in a non-magnetic field for 10 minutes to 3 hours.

8. A toroidal core comprising a low-loss amorphous alloy consisting essentially of the formula:

$$(Fe_{1-a-b}Nb_aM_b)_{100-c}X_c$$

wherein M is at least one metallic element selected from the group consisting of V, Cr, Mo, Ta and W; X is a combination of B and Si, the amount of Si being more than 0 to 10 or less atomic percent; and a, b and c statisfy the relations of $0.01 \leqq a \leqq 0.075$, $0. \leqq b \leqq 0.05$, $0.02 \leqq a+b \leqq 0.075$ and $12 \leqq c \leqq 21$, respectively.

9. A toriodal core as in claim 8 and wherein said core comprises the core of a transformer.

* * * * *